United States Patent [19]

Mancini

[11] 3,967,434

[45] July 6, 1976

[54] CARTONNING APPARATUS

[75] Inventor: Derek Mancini, Stouffville, Canada

[73] Assignee: Portion Packaging Limited, Rexdale, Canada

[22] Filed: May 19, 1975

[21] Appl. No.: 578,713

[52] U.S. Cl. ..... 53/186; 53/374; 93/53 R

[51] Int. Cl.[2] ..... B65B 43/28

[58] Field of Search ..... 53/186, 374; 93/53 R

[56] References Cited

UNITED STATES PATENTS

| | | | |
|---|---|---|---|
| 2,318,208 | 5/1943 | First et al. | 53/186 X |
| 2,429,071 | 10/1947 | Pirie | 53/126 |
| 2,764,123 | 9/1956 | Derderian | 53/374 X |
| 3,420,037 | 1/1969 | Villemure et al. | 53/186 |
| 3,442,063 | 5/1969 | Martin | 53/186 X |

*Primary Examiner*—Travis S. McGehee

[57] ABSTRACT

Automatic cartonning apparatus comprising a conveyor which is advanced at intermittent intervals a predetermined distance, the apparatus being provided with means operable following conveyor advance to withdraw a single carton blank from a stack of carton blanks and open same up to a set up condition ready to receive a plurality of articles on the conveyor at a first position, the carton in said set up condition having a closed bottom and open top end and side flaps, the apparatus further being provided with means for guiding articles into a set up carton at a second carton loading position displaced along the conveyor path a whole multiple of said predetermined distance from said first position, means operable following conveyor advance for closing the carton end flaps at a third carton flap closing position displaced along the conveyor path a whole multiple of said predetermined distance from said second loading position, means for closing the carton side flaps subsequently to the closing of the end flaps and control means for controlling the conveyor such that the event of conveyor advance is adapted to be related to the completion of the filling of a set up carton at the carton loading position.

17 Claims, 15 Drawing Figures

FIG. 9
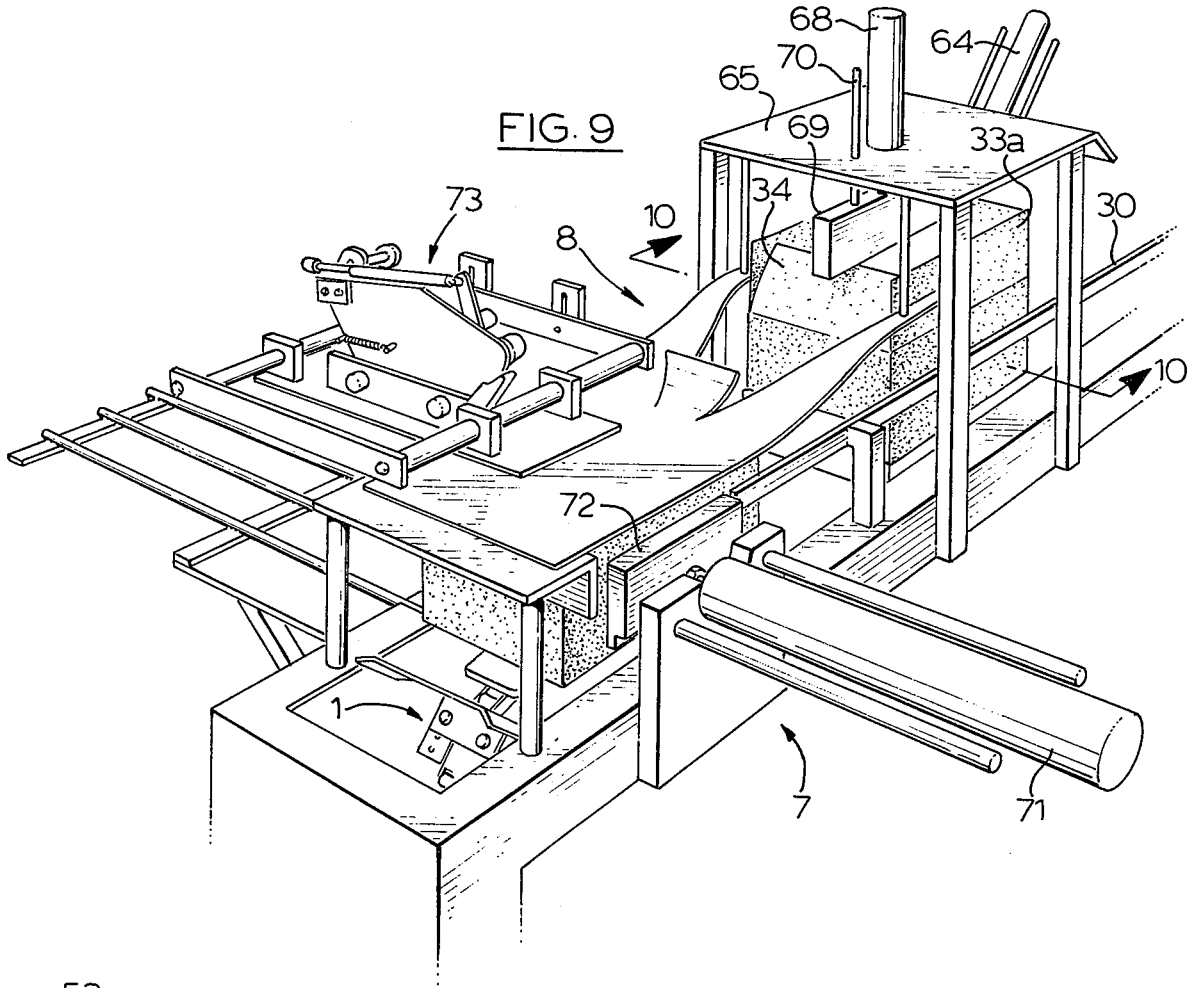
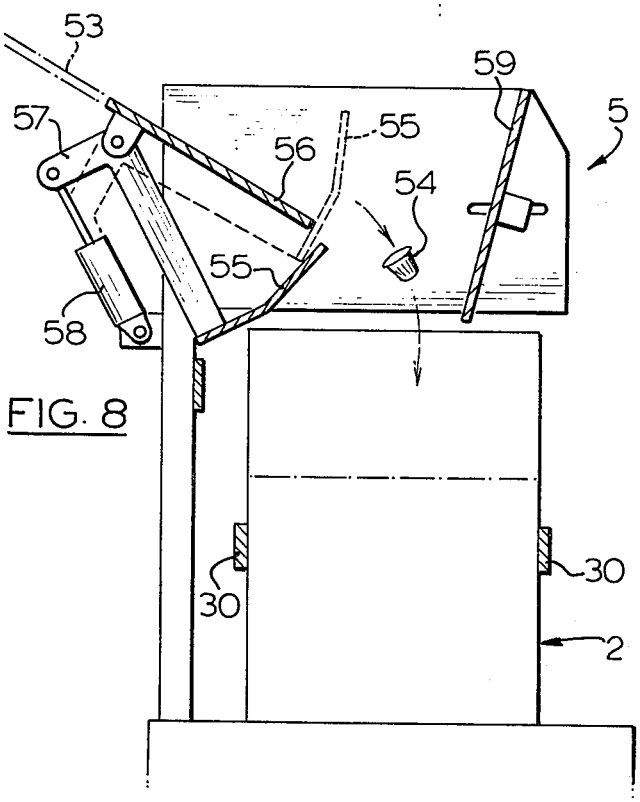
FIG. 8
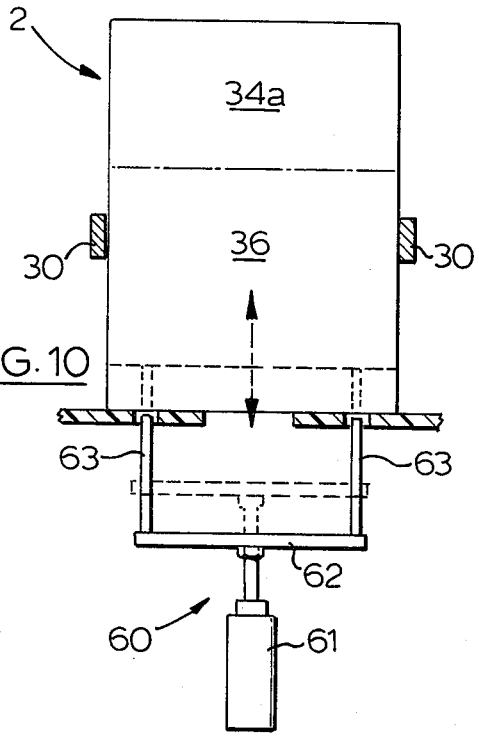
FIG. 10

CARTONNING APPARATUS

This invention relates to apparatus for automatically effecting the cartonning of a plurality of items or articles and more particularly to apparatus capable of automatically cartonning such articles which are delivered to the loading station on a continuous basis. The invention further relates to such apparatus for cartonning items and articles which are subject to fracture or crushing and cannot conveniently be individually handled and are introduced into the carton at the loading station in randomly piled relation.

More particularly the invention relates to apparatus for use with flat carton blanks of the type which are adapted to be set up under endwise telescoping movement and according to the invention there is provided apparatus for automatically withdrawing a single carton blank from a magazine while effecting set up of the blank into carton configuration, feeding the set up carton to a loading station to receive a plurality of items or articles and following completion of loading, feeding the loaded carton to a flap closing station and finally discharging the loaded and closed carton. Further the preferred form of automatic cartonning apparatus embodying the invention additionally provides for the redistribution of the articles or items which may be discharged into the carton in a randomly piled orientation at the loading station and which may be subject to fracture or crushing, such redistribution effecting downward displacement of the articles out of interference with the top closure flaps as they are swung downwardly in the carton closing operation.

BACKGROUND OF THE INVENTION

Where it is desired to pack a number of items or articles in cartons, particularly where the number is considerable and the items or articles are small and are susceptible to fracture or crushing and are not readily individually handled, at present at least some of the cartonning operations involve manual manipulation. For instance, while the cartons to be employed are set up from prepared, flat folded blanks that have portions of the bottom flaps glued so that they can be set up by telescoping the flat blanks endwise to produce a rectangular carton having a closed bottom and open top with upstanding top closure flaps, there is at present no simple means available for automatically setting up the cartons and feeding them into a system in synchronism with the carton loading cycle of the cartonning operation and this step is normally done manually. Also to prevent breakage or crushing of the items or articles that have been discharged in a random pile into the carton during the carton top closing operation, manual redistribution or shake down is usually required unless the carton is oversized, because the initial pile will project above the closed carton top level and unless redistribution occurs the closing of the top flaps will cause damage to the contents and proper closure may not be attained. If, on the other hand, the carton is oversized so that such redistribution is not required, the items instead of being snugly packed are loose in the carton and are subject to breakage or crushing due to their shifting an any subsequent rough handling of the carton.

It is the object of the invention to overcome the above problems and provide a relatively simple cartonning apparatus which can be totally synchronized to the carton filling cycle at the carton loading station which is dependent upon the delivery of the items or articles for cartonning and will eliminate all manual manipulation from the cartonning operation.

SUMMARY OF THE INVENTION

According to the invention, there is provided a relatively simple compact and reliable automatic cartonning apparatus comprising a conveyor, means for withdrawing a single carton blank from a stack and delivering same to the conveyor while simultaneously opening it out to its set up condition, means for advancing the conveyor a predetermined distance to advance a set up carton to a loading station while simultaneously advancing a carton which has been previously filled with articles at the loading station to an end flap closing station, and a carton which has previously been filled and has its end flaps closed to a discharge station, means at the end flap closing station for effecting end flap closure and means for effecting closure of the side flaps subsequently to the closure of the end flaps, the machine cycle being characterized in that the means for advancing the conveyor is adapted to be made responsive to the completion of the filling of a carton at the loading station and the carton blank withdrawing means and the end flap closing means are actuated subsequently to conveyor advance and while a fresh empty carton is being filled at the loading station.

Further according to the preferred form of the invention the means for advancing the conveyor is a reciprocating mechanism having a predetermined stroke. In this connection according to the preferred embodiment of the invention, the reciprocating mechanism comprises an air driven, oil operated hydraulic cylinder.

Further according to the preferred embodiment of the invention, to enable the use of cartons of a size which will snugly receive the quantity of articles to be cartonned and at the same time permit the random piling of the articles into the carton, a shaker mechanism is provided which may be located at the end flap closing station and this shaker mechanism is operable to effect carton shaking and article redistribution in the carton to preclude end flap interference on end flap closure prior to the operation of the end flap closure means.

For simplicity, according to the preferred form of the invention, the side flap closure is effected by side flap guides or cams during the delivery of the carton to the discharge station. Also according to the preferred form of the invention, the closed carton is taped to hold same closed by taping mechanism activated by discharge of the closed carton out of the discharge station in a direction laterally of the conveyor feed and laterally of the side flap lengths.

The invention has particular application to the automatic cartonning of articles which are fed continuously to the carton loading station and in this connection for the handling of the continuous delivery of the articles, gate means are provided at the carton loading station to interrupt and accumulate the incoming articles while the conveyor is in operation to advance a filled carton out of and an empty set up carton into the loading station. To synchronize the cartonning operation with such continuous feed, it will be understood that the article feeding means or machine will be utilized to govern the event of conveyor advance, whereupon the conveyor is advanced after delivery of a predetermined number of articles.

These and other objects and features of the invention will become apparent from the following detailed description.

DESCRIPTION OF THE DRAWINGS

FIG. 8 is a vertical sectional view taken on the line 8—8 of FIG. 1 showing the loading hopper and control gate.

FIG. 9 is a perspective view partly broken away of the discharge end of the apparatus.

FIG. 10 is a vertical sectional view taken on the line 10—10 of FIG. 9, showing the shaker apparatus.

DETAILED DESCRIPTION OF THE INVENTION

Figure 1:
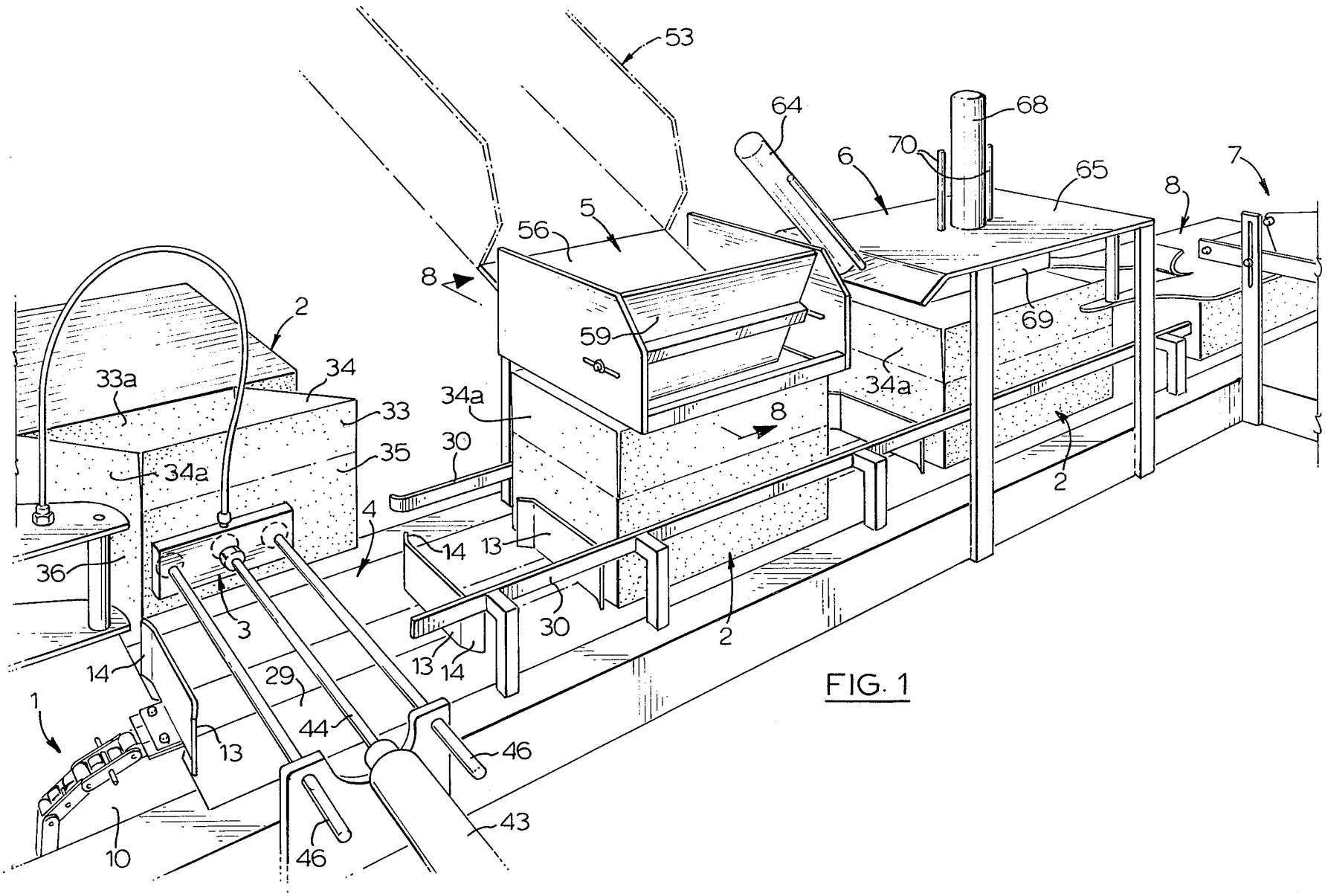
FIG. 1 is a perspective view partly broken away of a cartonning apparatus embodying the invention and showing the conveyor in a stopped condition with a set up carton at the loading position to receive articles to be delivered therein and the carton blank withdrawing mechanism in the act of withdrawing and opening up a carton blank.

Referring first to FIG. 1 illustrating a preferred embodiment of the invention, it will be seen that the cartonning machine or apparatus comprises generally a conveyor 1 onto which the foremost carton blank of a horizontal stack of cartons 2 is drawn while being set up by carton blank withdrawing mechanism, generally designated at 3 at a first carton blank conveyor loading position or station indicated at 4.

Spaced along the conveyor a predetermined distance as hereinafter more fully described at a second carton loading position or station is an article loading chute 5.

Spaced a similar predetermined distance along the conveyor at a third end flap closing position or station is an end flap closing mechanism generally designated at 6.

At a still further predetermined distance along the conveyor is a discharge position station designated at 7 and guide means generally designated at 8 extending between the end flap closure position or station 6 and the discharge station 7 provide for the closure of the filled carton side flaps.

Conveyor Mechanism

Figure 2:
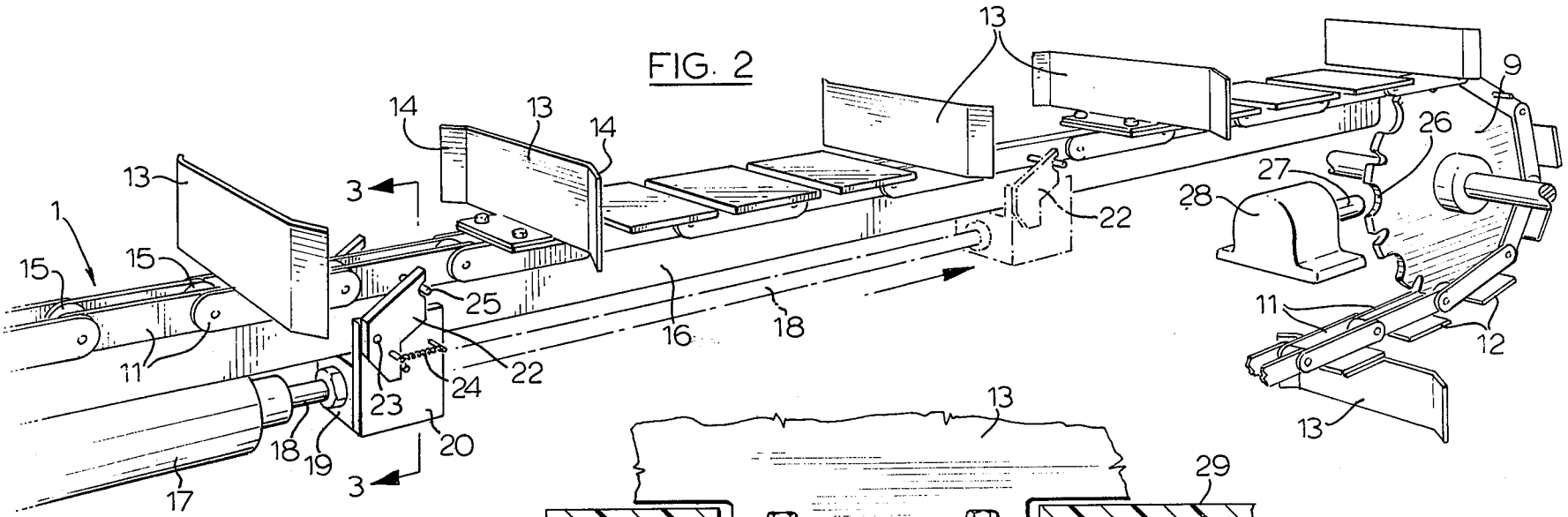
FIG. 2 is a broken away perspective view of the conveyor mechanism.
Figure 3:
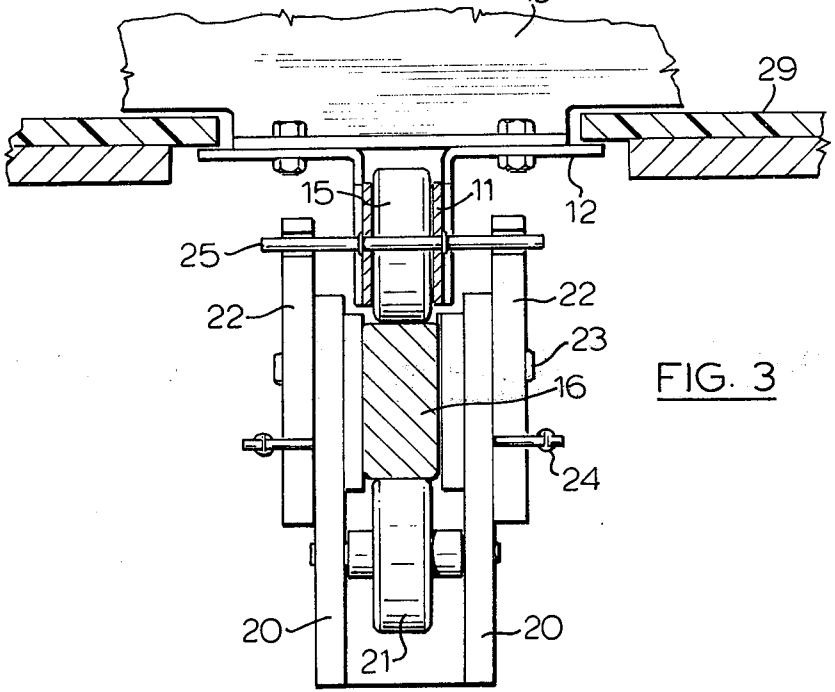
FIG. 3 is a verticle sectional view on the line 3—3 of FIG. 2.
Figure 6:
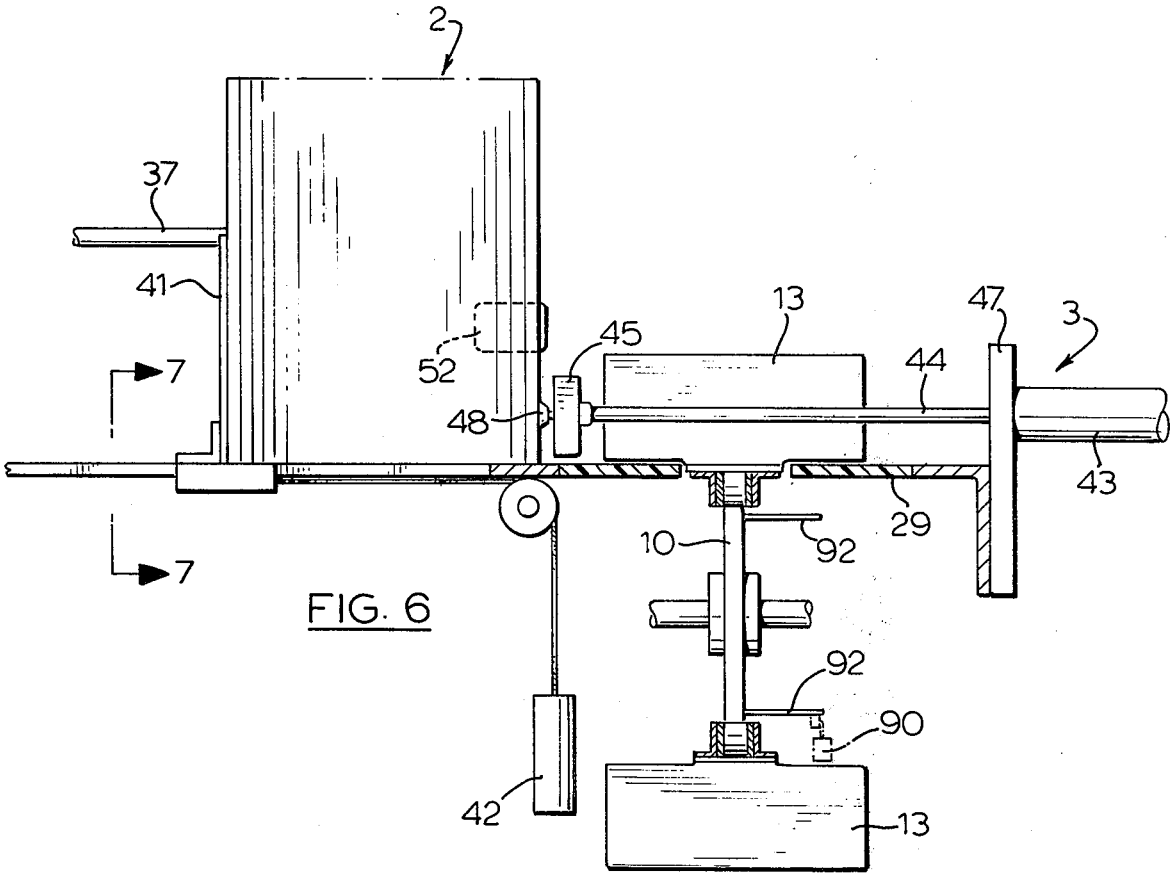
FIG. 6 is a part side elevational, part vertical sectional view illustrating the relationship of the carton withdrawing mechanism and the carton blank magazine and carton blank stack at carton pick up.
Figure 7:
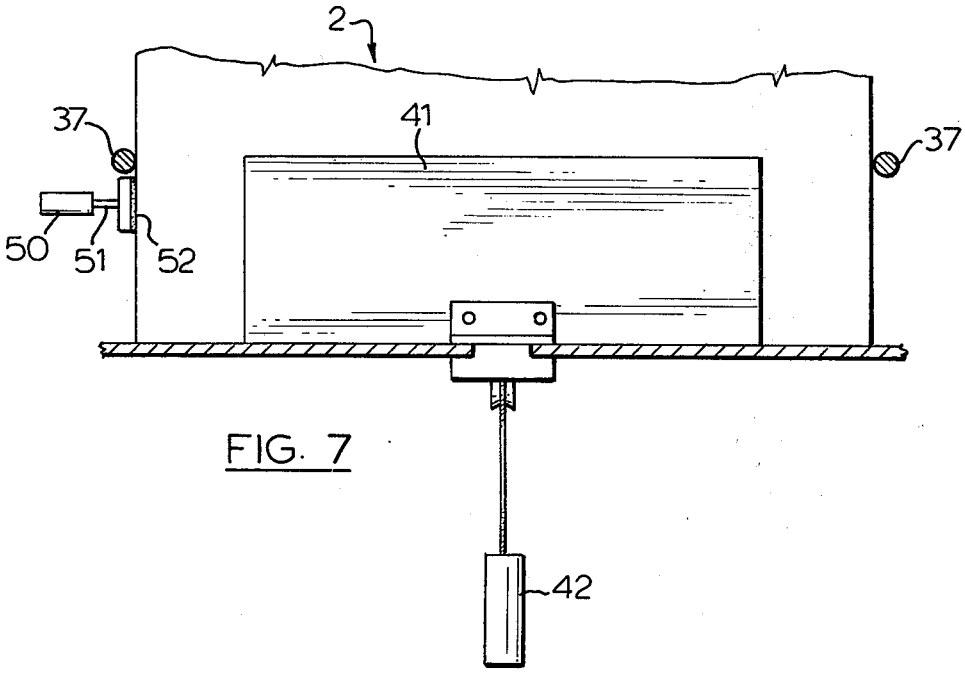
FIG. 7 is a part vertical sectional, part elevational view taken on the line 7—7 of FIG. 6.

As more particularly seen in FIGS. 2 and 3, the conveyor 1 comprises an endless roller chain conveyor trained over sprockets 9 (FIG. 2) and 10 (FIGS. 1 and 6). Mounted on the links 11 of the conveyor 1 are a plurality of plates 12 to spaced ones of which are secured upright carton guides 13, the spacing between the adjacent carton guides being such as to snugly receive therebetween a set up carton.

The ends of the guides 13 are flared outwardly as at 14 away from the space therebetween into which the set up carton is adapted to be received to assist in the guiding of the carton onto and off the conveyor.

As seen particularly in FIG. 3, the links 11 of the conveyor carry rollers 15 and the upper reach of the conveyor is supported by a fixed bar 16 extending centrally longitudinally of the conveyor on which the rollers 15 roll.

The conveyor is adapted to be moved a precisely fixed predetermined distance subsequent to the filling of a set up carton at the filling position 5 to advance a fresh set up carton and thereafter to remain stationary until subsequently to the filling of the latter carton.

Figure 4:
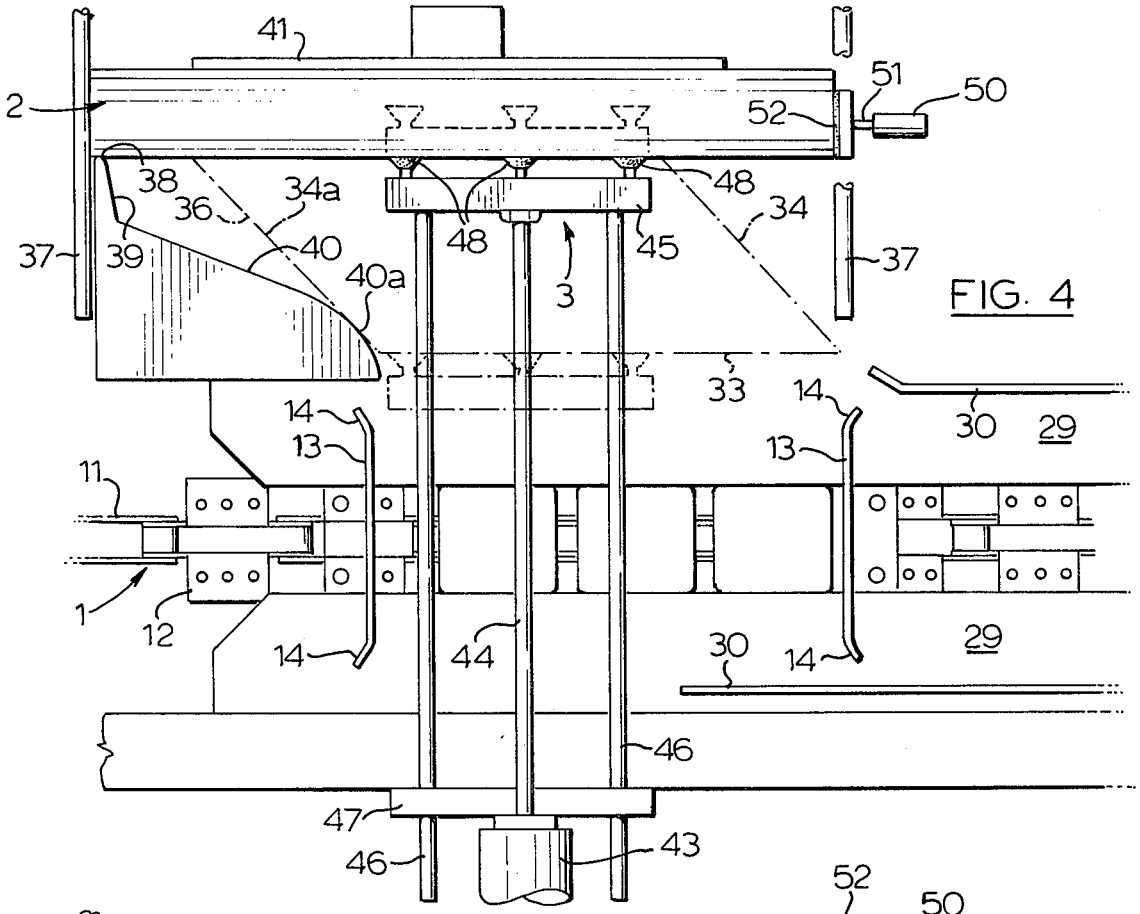
FIG. 4 is a plan view partly broken away of the carton blank magazine and the carton withdrawing mechanism in the act of picking up the foremost carton in the carton stack.

The means for achieving the requisite conveyor movement is particularly illustrated in FIGS. 3 and 4 and preferably comprises an air/oil operated cylinder 17 located beneath the upper reach of the conveyor and having a piston rod 18 to the free end of which is fixed a carriage 19 comprising side plates 20 which extend upwardly on opposite sides of the conveyor chain. Journalled between the side plates 20 is a roller 21 which rolls on the underside of the longitudinal support bar 16. Mounted on the side plates 20 are spring actuated latches 22 which are urged upwardly about their pivots 23 by springs 24. These latches 22 are adapted to engage outwardly extending abutment pin extensions 25 of the conveyor which may simply be extensions of the axis of one of the conveyor rollers 15. The stroke of the piston rod 18 is a fixed predetermined distance and as the piston rod is extended, the latches 22 engaging the pin extensions 25 advance the conveyor from the solid line position of the latches to the dotted line position illustrated in FIG. 2. Thus the conveyor is moved a precise predetermined distance. On retraction of the piston rod 18 it will be understood that the latches 22 will be required to pass beneath a subsequent set of pin extensions 25 which will now occupy the position of the solid line pin extensions in FIG. 2 and this will be accommodated by the pivoting of the latches against the action of the springs 24 as they pass beneath these pin extensions after which the latches will recover to the solid line position shown in FIG. 2. To ensure that the conveyor remains stationary following its advance and during retraction of the piston rod 18, the sprocket 9 is provided with locking notches 26 into which a plunger 27 of an air cylinder 28 is adapted to enter immediately following conveyor advance, as hereinafter more fully explained.

It will be understood that the conveyor will operate between suitable support and cover plates 29, FIG. 3 and side guides 30, FIG. 1.

Carton Blank Withdrawing and Set Up Mechanism

Figure 5:
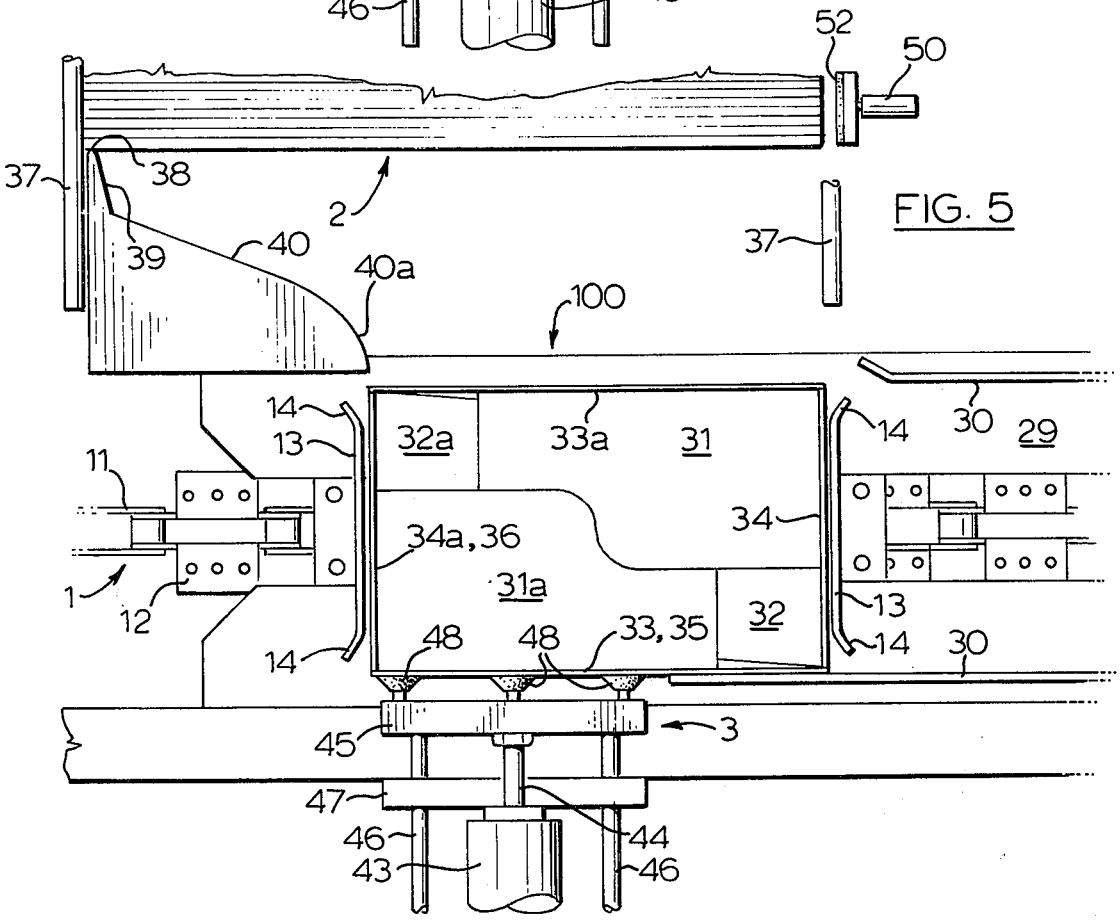
FIG. 5 is a view similar to FIG. 4 but showing the carton blank in the set up condition and in position on the conveyor.

With reference to FIGS. 1 and 4 to 7 inclusive, the operation of the carton blank withdrawing and set up mechanism will be readily understood. The carton blanks employed are the conventional preformed carton blanks which are adapted to be set up by an endwise telescoping movement. These blanks have longitudinal bottom side flaps 31 and 31*a* and transverse bottom end flaps 32 and 32*a* (FIG. 5). As is well understood, one of the corners of each of the longitudinal side flaps 31 and 31*a* is folded back and secured to a transverse end flap 32 and 32*a* respectively, and tucked up inside the flat carton blank so that when the flat carton blank is telescoped endwise, the bottom flaps automatically move to the position shown in FIG. 5 and form a complete bottom of the set up carton without any further operation. The top side flaps 33 and 33*a* and the top end flaps 34 and 34*a*, however, are not connected so that when the carton is set up they project upwardly as shown particularly in FIG. 1, leaving the carton open for filling but requiring subsequent closure of these top flaps.

In the flat condition, the carton blank as will be readily apparent from the partly opened out position of the blank in FIG. 1, will expose a side face 35 and a top side flap 33 which will extend to one end of the carton blank, e.g. the right hand end of FIG. 1, and an end face 36 and an end top flap 34 which will extend to the opposite end of the flat carton blank. As best seen in FIGS. 4 and 5, a horizontal stack of the carton blanks 2 are mounted in registered relation in a magazine constituted by side guides 37 on one side of the conveyor. Blocking forward movement of the stack of carton blanks towards the the conveyor at the blank end constituted by an end panel 36 which will on set up become a carton end face 36 is a narrow ledge 38 on the inside of which is a guide surface 39 which gradually converges towards the straight guide 37 at the opposite end of the blank stack. The guide surface 39 leads into a guide or cam surface 40 which sharply converges towards the opposite side guide 37 until it reaches a knee portion 40*a* which is rounded smoothly to approach parallelism with the opposite side guide 37 to provide therewith an exit 100 having a width approximately equal to the length of the carton blank side panel which becomes the carton side face 35.

As illustrated in FIG. 1, the ledge 38, guide surfaces 39 and 40 which are spaces upwardly towards the top of the carton blank, are duplicated adjacent the lower portion of the blank.

As particularly seen in FIG. 6, the stack of blanks 2 is urged towards the stop ledges 38 by a slide follower 41 actuated by a weight 42.

Figure 15:
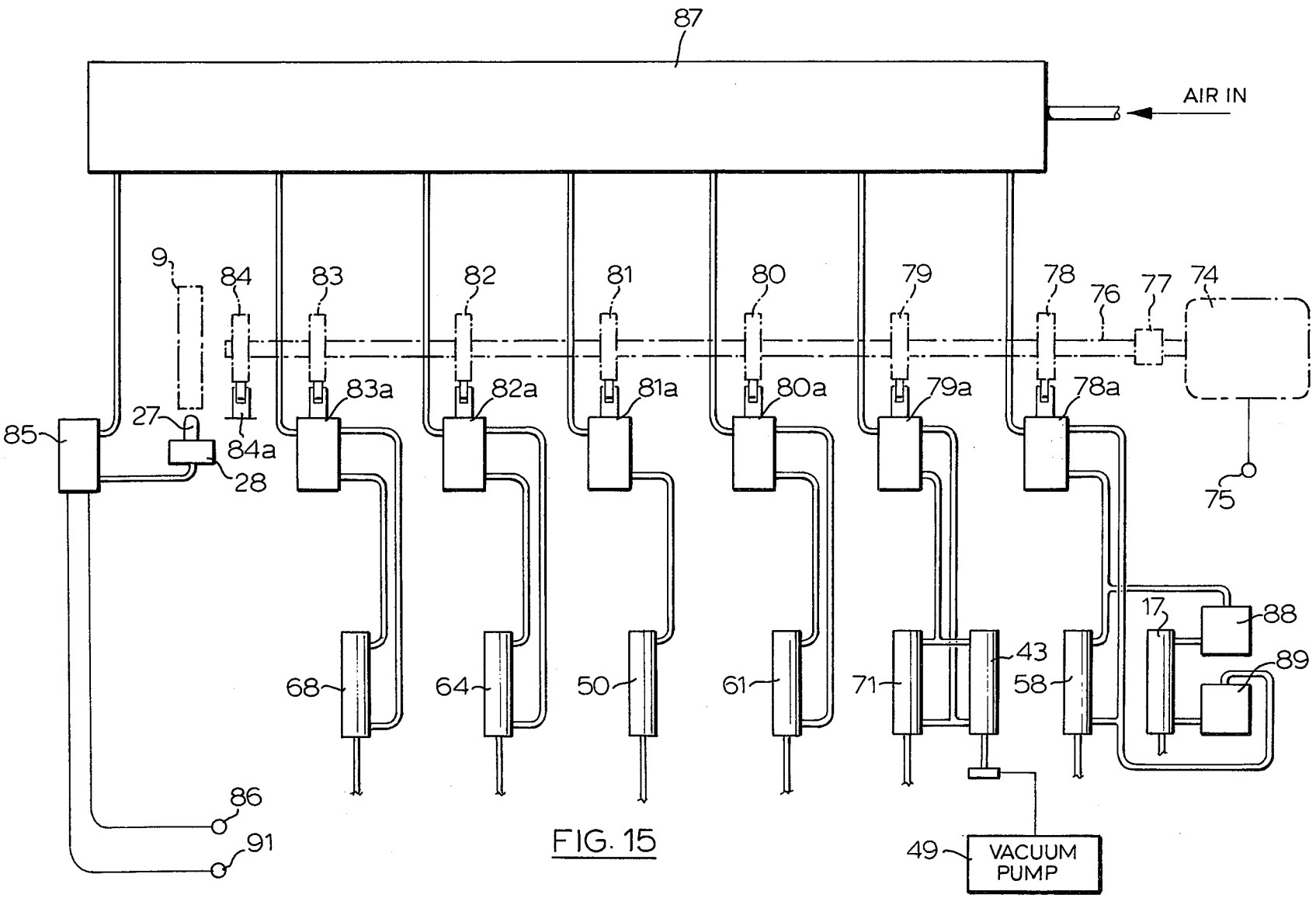
FIG. 15 is a pneumatic circuit diagram diagrammatically illustrating the machine functions.

The carton withdrawing mechanism generally designated at 3 comprises an air cylinder 43 having a piston 44 carrying a cross head 45 supported by guides 46 slidably operating through a support 47. The cross head 45 carries a plurality of suction cups 48 connected to an appropriate vacuum source 49 (FIG. 15). The cross head 45 is arranged to operate transversely of the conveyor from a retracted position (FIG. 5) on the side of the conveyor opposite to the carton blank stack to an extended position illustrated in dotted line in FIG. 4 at which point it has engaged the stack of carton blanks and displaced them rearwardly from the stop ledges 38 against the bias of the weight 42 to ensure that positive contact is made with the side face 35 of the leading or foremost carton blank and to ensure that all of the carton blanks are displaced behind the stop ledges 38.

Arranged at one side of th magazine as illustrated in FIG. 4 is an air cylinder 50 having a piston 51 carrying a friction head 52. As will hereinafter be more fully described immediately subsequent to the movement of the cross head 45 to its fully extended dotted line position of FIG. 4 and prior to the return of the cross head, the friction head 52 will be moved into engagement with the ends of the first few carton blanks of the stack to ensure that they are forced tightly against the opposite guide 37 behind the stop ledges 38 and to provide a frictional drag to prevent any tendency of any blank subsequent to the leading blank from following the leading blank as it is withdrawn.

As the cross head 4 moves from the solid line position in FIG. 4 towards its retracted position, it will be understood that the stop ledges 38 and the friction head 52 will tend to resist movement and the initial movement will tend to pull the front side face 35 of the carton blank away from the rear side face and this will tend to decrease the length of the carton blank so that the left hand edge as viewed in FIG. 4 will be pulled out from behind the stop ledges 38. Thereafter the right hand end of the carton blank will be constrained to move in a straight line path transversely of the conveyor while the left hand end of the carton blank which is constituted by the end panel or face 36 will be constrained by the guide surfaces 39 to move in a path having a component transverse to the direction of the right hand end with the result that there is, in effect, and endwise telescoping of the carton blank to effect its opening out and set up and the carton is substantially set up as it passes the final portion of the knee portions 40*a* of the guide surfaces and is drawn as a set up carton through the magazine exit 100 and onto the conveyor between the guides 13. Following retraction of the cross head 45 to draw the set up carton onto the conveyor as illustrated in FIG. 5, the suction will be released to release the set up carton so that it is free to be advanced by the conveyor.

It will be understood that the withdrawing and set up operation is accomplished while the conveyor is locked in the "at rest" position and the time required for withdrawing and setting up the carton blank is substantially less than the time for filling the carton with the desired articles or items which takes place at the loading station 5. Thus when a previously set up carton which has been delivered to the loading seation 5 is loaded, the next succeeding carton will have been set up at the first position or station and the carton withdrawing mechanism 3 will be clear of interference with the conveyor movement.

Carton Loading

While of course the carton may be loaded with any type of article or item at the loading position represented by the loading chute 5, a particular illustrative loading operation may be described in respect of the cartonning of a plurality of small containers of cream. In this connection there is shown in FIG. 1 a delivery through 53 which delivers for example the output of a cream filling and sealing machine and the set up carton at the loading position may be assumed for example to be loaded with a hunderd of such cream filled containers which, while they are sufficiently sturdy to sustain normal handling, are also susceptible to breakage or crushing. The set up carton must remain at the loading chute 5 for a period sufficient for the delivery of the hundred containers, one of which is represented at 54 in FIG. 8. Once the hundred containers have been delivered into the set up carton then the now filled carton is ready to be moved to the end flap closing station at which the end flap closing mechanism is located and a previously set up carton must be delivered beneath the loading chute 5 for receiving the freshly arriving containers. In this connection, according to the invention, the control of the cartonning apparatus is made dependent upon the delivery of the requisite quantity or number of items, e.g. containers 54, into the set up carton at the loading chute 5. Thus for example, when the machine delivering the containers 54 has delivered 100 containers, it can be arranged to trip a suitable switch (not shown) to deliver a signal to the cartonning apparatus control mechanism (e.g. to the terminal 75, FIG. 15) to initiate its cycle, as hereinafter more fully described. In order to preclude the necessity of interrupting the feed of the items, e.g. containers 54, to the cartonning apparatus while the filled carton is being moved away from the chute 5 and the subsequent set up carton is being delivered to the chute, a gate 55 (FIG. 8) is provided to temporarily accumulate containers on the chute guide surface 56 leading into the chute. The gate 55 is carried by a bell crank 57 operated by an air cylinder 58 to move into the dotted article accumulating position immediately upon the signal being given that the requisite quantity, e.g. 100 containers, has been delivered into the loaded carton. It will be understood that the gate 55 will remain in article accumulating position unitl completion of the conveyor movement to advance the filled carton out of the loading station and an empty set up carton into the loading station, thereupon the gate will be retracted and filling of the new empty carton will be commenced.

The chute 5 is preferably provided with an adjustable end wall 59 to regulate the chute discharge opening in accordance with the size of the item being discharged into the carton.

It will be understood that if the carton is for example of a size to just snugly receive 100 cream containers 54, and these cream containers are simply dropped centrally into the set up carton, they will not be uniformly distributed throughout the carton but will pile up to a level above the fold lines of the top flaps 33, **33*a*, 34 and 34*a*, so that if the containers are not redistributed and the flaps are closed down, crushing of the containers and spillage of their contents will occur. On the other hand, of course, if the carton is oversize, this problem may disappear but the containers 54** will not be snugly cartonned but will be subject to violent shifting under rough handling of the filled carton.

Content Redistributing and End Flap Closing Station

Figure 11:
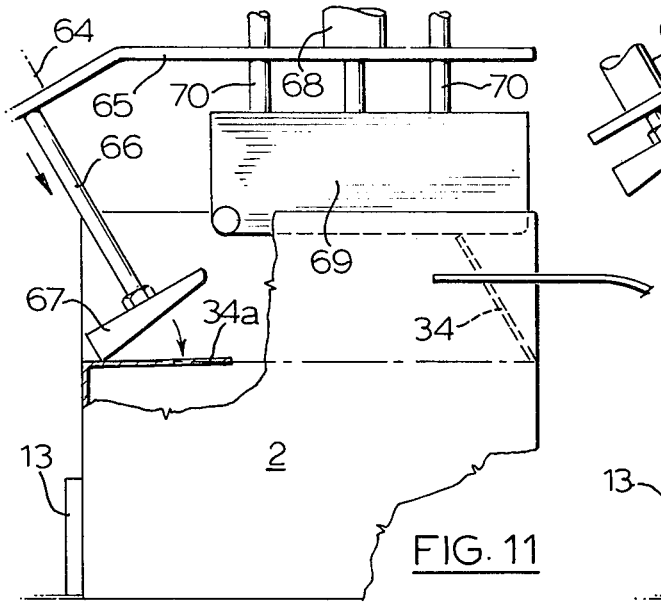
FIG. 11 is a side elevational view partly broken away showing the means for closing the carton end flaps and showing the trailing flap closure device in the flap closing position.
Figure 12:
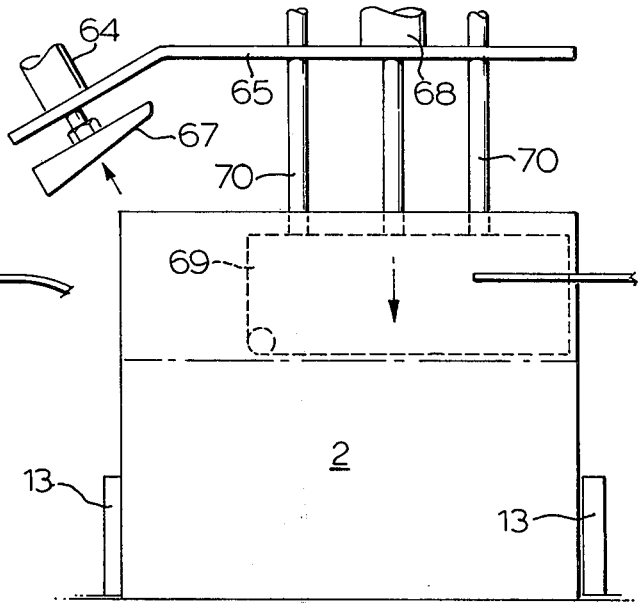
FIG. 12 is a view similar to FIG. 11 but showing the leading end flap closure device in flap closing position.
Figure 13:
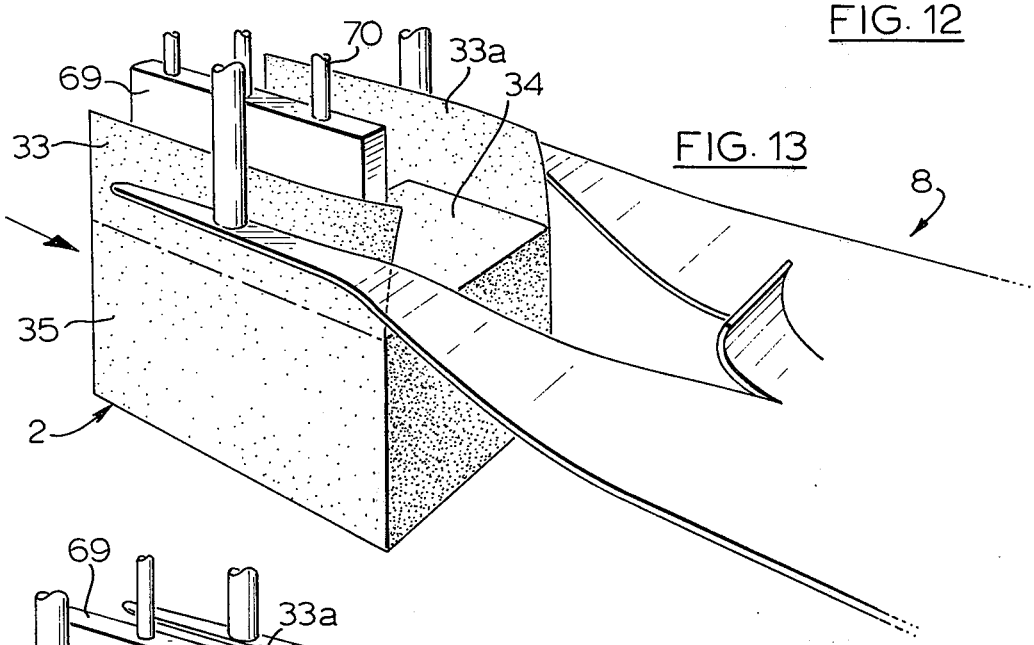
FIGS. 13 and 14 are perspective views illustrating the guide means employed in closing the carton side flaps.
Figure 14:
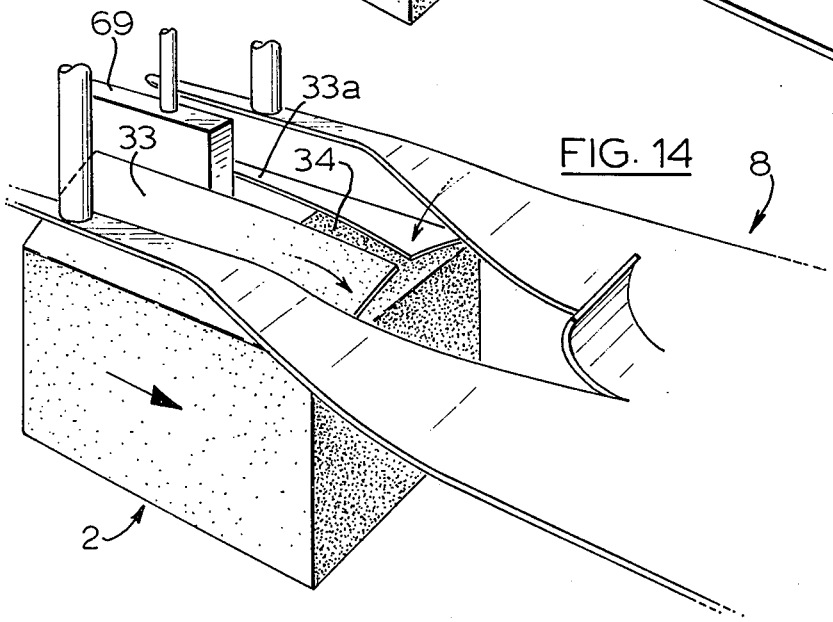

Following filling of a carton and receipt of a signal to effect conveyor operation, the filled carton will be advanced by the conveyor beneath the end flap closing mechanism 6 shown in FIG. 1 and more particularly in FIGS. 9, 11 and 12. In each case it will be understood that the various positions or stations are precisely spaced along the conveyor the exact distance of the stroke of the piston 18 of the conveyor advancing cylinder 17 (or a whole multiple thereof). Located beneath the end flap closing station 6 is a shaker mechanism shown in FIG. 10 which is actuated to effect redistribution of the containers 54.

This shaker mechanism generally designated at 60 comprises simply an air cylinder 61 carrying a cross head 62 from which extend a pair of parallel vertical plates 63 which are adapted to move into contact with the bottom of the filled carton at spaced points to raise the carton from the conveyor and to subsequently allow the carton to drop. It will be understood that the air cylinder 61 will be operated to effect a repeated reciprocation of the cross head 62 so that the loaded carton will be raised and dropped several times to disperse the container pile into the carton corners prior to the end flap closing operation.

Subsequently to the operation of the shaker mechanism 60, air cylinder 64 which is disposed above the filled carton at the trailing end thereof and is supported from platform 65 so that its piston 66 is adapted to operate obliquely downwardly and forwardly, is actuated to move a shoe 67 carried at the free end of the plunger 66 into engagement with the trailing end flap 34 to force same forwardly and downwardly to the closed position as illustrated in FIG. 11. Immediately thereafter the piston 67 of cylinder 68 carrying longitudinal clamp plate 69 moves downwardly to close the leading end flap **34*a* and to also hold down the previously closed trailing end flap 34 as the shoe 66 is retracted. It will be understood that the initial closing of the leading end flap 34*a* is achieved by the forward motion of the filled container as the leading end flap contacts and moves under the clamp plate 69 which in its retracted position is low enough to effect the initial closing of the leading end flap. Preferably the clamp plate 69 is guided in its movement by suitable guides 70**.

The closing of the side flaps 33 and **33*a* is effected by the guide means 8 on the next sequential operation of the conveyor to move the next filled carton to the end flap closing station and the carton whose end flaps have just been closed, to the discharge station 7, best seen in FIG. 9. It will be understood that the clamp plate 9 will be maintained depressed until the guide means 8 have effected sufficient closure of the side flaps 33 and 33*a*** so that the end flaps will be held down thereby and can be released by the clamp plate.

Dishcarge Station

Again, it will be understood that the discharge station will be the precise stroke (or multiple thereof) of the conveyor operating piston 18 displaced from the end flap closing station and it will be seen from FIG. 9 that the guide means 8 extends over the discharge station to retain the closed flaps 33, **33*a*, 34 and 34*a* in the closed position. Discharge of the filled and closed carton out of the discharge station 7 is effected by an air cylinder 71 whose piston carries a pusher block 72 that moves transversely across the conveyor to push the filled and closed carton beneath a taping mechanism 73 of conventional design and which delivers a tape to an article brought into frictional contact therewith. The taping mechanism per se is not part of the present invention and no further description is deemed necessary. However, it is to be noted that the filled and closed carton is moved transversely of the conveyor, that is, transversely of the length of the longitudinal top side flaps 33 and 33*a*** so that the tape is applied across these side flaps so that the carton is secured closed with a minimum of taping.

Control Circuit

With reference to FIG. 15, the control of the cartonning apparatus or machine is effected by means of a motor 74 which is arranged to be started upon receipt of a signal delivered from the carton loading station upon completion of the loading of a carton, e.g. by the automatic closing of a micro switch actuated by any continuous article feeding or delivering mechanism with which the automatic cartonning apparatus of the present invention is to be used as hereinbefore indicated, to the terminal 75. The motor 74 on being started drives a shaft 76 through a suitable reduction drive 77 and this shaft 76 carries a plurality of cams 78 to 84 shown in diagrammatic form. At the same time that a signal is delivered to the terminal 75, it is also delivered to a solenoid control valve 85 through terminal 86 to effect a withdrawal of the sprocket locking plunger 27 to permit conveyor movement.

The first cam 78 immediately upon commencement of rotation of the shaft 76 operates an air valve 78*a* to direct air from a manifold 87 into an air/oil tank 88 to actuate the conveyor cylinder piston 18 to advance the conveyor and to thereafter effect retraction of the piston 18 through reversal of the air to the air/oil tank 89.

To lock the conveyor against movement immediately after its advance and during retraction of the piston 18 a micro switch 90, FIG. 6, is actuated to deliver a signal to terminal 91 to solenoid control valve 85 to effect release of the locking plunger causing it to enter a subsequent notch in the sprocket 10 which will have been brought into registration therewith in the conveyor advance stroke. In this connection as a specific illustration the stroke of the piston 18 may be made to advance the conveyor a distance to turn the sprockets 9 and 10 precisely 180° and there will be notches in sprocket 9 in 180° relation. At the same time sprocket 10 will carry micro switch actuating arms or flags 92 in 180° relation as shown in FIG. 6 to trip the micro switch 90 to lock the conveyor at the end of each conveyor advance movement or 180° sprocket rotation.

Referring again to FIG. 15, at the same time that the conveyor is operated, the valve 78*a* also operates to raise the chute gate 55 to effect accumulation of continuously arriving articles during the conveyor advance.

Following completion of the conveyor advance, cam 79 is adapted to operate valve 79*a* to actuate the carton withdrawing and setting up apparatus constituted by the piston 44, cross head 45, suction cups 48 and associate apparatus. At the same time the cylinder 71 is actuated to operate the pusher block 72 to discharge a previously filled and closed carton which has been delivered to the discharge station 7.

Immediately following conveyor advance, cam 80 operates valve 80*a* repeatedly to effect repeated operation of the shaker mechanism 60.

Following completion of the operation of the shaker mechanism, cam 82 actuates valve 82*a* to operate the trailing end flap closing plunger 66 of cylinder 64, following which cam 83 actuates valve 83*a* to close down the longitudinal clamp plate 69 and to hold same down pending carton advance, but to drive same upwardly prior to arrival of the next loaded carton.

Cam 81 which actuates valve 81*a* actuates this latter valve immediately after the cross head 45 has moved into engagement with the carton blank stack and displaced same away from the conveyor, the valve 81*a* operating the piston 51 of the cylinder 50 to being friction head 52 into end engagement with the carton blanks during the period that the cross head 45 is retracting to withdraw and set up a carton blank.

Upon completion of one revolution of the cam shaft 76, cam 84 operates switch 84*a* to shut off the motor completing the machine cycle and the machine then awaits the next signal signalling that the newly advanced carton has been filled and the machine cycle needs to be repeated.

From the foregoing it will be apparent that a cartonning apparatus has been provided that is adapted to be tied to the delivery rate of continuously supplied articles it is desired to carton and the cartonning will be completely automatically effected with interruption of the delivery schedule.

While a specific embodiment of the apparatus and the various component mechanisms has been shown and described, it will be obvious to those skilled in the art that many variations and alterations may be made in the specific apparatus without departing from the spirit of the invention or scope of the appended claims.

I claim:

1. An automatic cartonning apparatus comprising a conveyor, means for advancing said conveyor a predetermined distance, means operable following conveyor advance to withdraw a single carton blank from a stack of carton blanks and open same up to a set up condition ready to receive a plurality of articles on said conveyor at a first position, said carton in said set up condition having a closed bottom and open top end and side flaps, means for guiding articles into a set up carton at a second carton loading position displaced along the conveyor path a whole multiple of said predetermined distance from said first position, means operable following conveyor advance for closing the carton end flaps at a third carton flap closing position displaced along the conveyor path a whole multiple of said predetermined distance from said second loading position, means for closing the carton side flaps subsequently to the closing of the end flaps and control means for said conveyor advancing means, said means for withdrawing and setting up a carton on said conveyor comprising reciprocal suction means operable in one direction for engaging the leading side panel of the foremost blank of a stack of carton blanks displaced from the path of said conveyor and operable in the opposite direction to first draw said leading side panel away from said stack and towards the conveyor to initiate the opening out of the carton blank towards the set up condition and to subsequently draw the set up carton onto the conveyor at said first position, and means for effecting displacement of an end panel of the blank in a direction transversely of the direction of the side panel movement as same is being drawn towards the conveyor to complete the carton set up.

2. An automatic cartonning apparatus as claimed in claim 1 in which means are provided to frictionally engage an end of the foremost carton blank and at least the next following carton blank immediately prior to the withdrawing of the foremost blank to provide a drag resisting withdrawal of said foremost blank to aid in the opening out of the blank and to hold the next following blank against withdrawal.

3. An automatic cartonning apparatus as claimed in claim 2 in which said means for frictionally engaging said carton blank ends comprises a friction pad mounted on the end of a plunger of an air operated cylinder, said plunger being movable into frictional carton end engagement immediately prior to the foremost blank withdrawal and being movable to release the carton blanks following the drawing of the set up carton onto the conveyor.

4. An automatic cartonning apparatus as claimed in claim 2 in which said means for effecting transverse displacement of said foremost carton end panel includes guide surfaces interposed in the path of said end panel as the carton blank is being withdrawn towards the conveyor and converging towards the path the side panel travels as the carton is drawn onto the conveyor.

5. An automatic cartonning apparatus as claimed in claim 1 in which the carton blanks are stacked in upright face to face relation, one behind the other, for horizontal feed in a magazine disposed at one side of said conveyor, first guide means associated with said magazine for guiding one end of the exposed carton blank face of the foremost carton blank which is to constitute the side panel of the carton in a straight line path extending transversely of said conveyor and second guide means associated with said magazine for guiding the opposite end of the exposed carton blank face which is to constitute the end panel of the carton — first in a path slightly converging towards said straight line path and subsequently on a path rapidly converging towards said straight line path until said carton end panel is displaced into substantially right angular relation to said side panel, narrow ledge means at the commencement of said second guide means to impede initial movement of said opposite carton blank end along said second guide means, and means biasing the carton stack against said ledge means, and said means for withdrawing a single carton blank from the stack and opening same up comprises reciprocal suction means operable first to move transversely across said conveyor and against the side panel of the foremost blank and to displace said blank stack away from the conveyor and from said ledge against siad biasing means and thereafter, in returning towards said conveyor, to draw said side panel in a straight line path transversely of said conveyor to first effect release of the end panel from behind said ledge means and thereafter movement of said end panel against said guiding means to bring same into substantially right angular relation to said side panel to effect box set up and thereafter in returning across said conveyor to draw the set up carton onto the conveyor and release same.

6. An automatic cartonning apparatus as claimed in claim 5 in which means are provided to frictionally engage the ends of the foremost and at least next subsequent carton blanks which constitute ends of the carton side walls immediately prior to return of said reciprocal means to retain said next subsequent carton blank in said magazine behind said ledge means as the foremost carton blank is withdrawn.

7. An automatic cartonning apparatus comprising a conveyor, means for advancing said conveyor a predetermined distance, means operable following conveyor advance to withdraw a single carton blank from a stack of carton blanks and open same up to a set up condition ready to receive a plurality of articles on said conveyor at a first position, said carton in said set up condition having a closed bottom and open top end and side flaps, means for guiding articles into a set up carton at a second carton loading position displaced along the conveyor path a whole multiple of said predetermined distance from said first position, means operable following conveyor advance for closing the carton end flaps at a third carton flap closing position displaced along the conveyor path a whole multiple of said predetermined distance from said second loading position, means for closing the carton side flaps subsequently to the closing of the end flaps and control means for said conveyor advancing means whereby the event of conveyor advance is adapted to be related to the completion of the filling of a set up carton at said second carton loading position, said means for advancing said conveyor said predetermined distance comprising an oil operated cylinder driven by compressed air.

8. An automatic cartonning apparatus as claimed in claim 7 in which said means for guiding articles into a set up carton comprises a chute, and gate means are provided to block said chute and means for operating said gate means to close said chute during conveyor advance and to release said chute upon completion of conveyor advance.

9. An automatic cartonning apparatus as claimed in claim 8 in which said control means for said conveyor advancing means comprises a switch means arranged to be actuated upon the delivery of a predetermined number of articles into said chute from a continuous article feed.

10. An automatic cartonning apparatus as claimed in claim 7 in which means are provided at said flap closing position for repeatedly raising and dropping the filled carton to effect article redistribution prior to closing of the carton end flaps.

11. An automatic cartonning apparatus as claimed in claim 10 in which the means for closing the trailing end flap comprises an air cylinder having a flap closing plunger operating obliquely downwardly and forwardly of the conveyor path and means for closing the leading end flap comprises vertically reciprocal longitudinal means located in its retracted position above the conveyor a distance such as to effect partial closing of said leading end flap upon carton movement therebeneath and operable downwardly after closure of said trailing end flap to complete closure of said leading end flap and hold down said trailing end flap pending initiation of closing of said side flaps.

12. An automatic cartonning apparatus as claimed in claim 7 in which said means for closing said carton side flaps comprises guide means acting against said side flaps as the carton is advanced from said carton flap closing position to a carton discharge position.

13. An automatic cartonning apparatus as claimed in claim 12 in which means are provided to discharge a loaded carton from said discharge position in a direction transversely of said conveyor.

14. An automatic cartonning apparatus as claimed in claim 7 in which said control means is rendered operative in response to an external signal to effect conveyor advance and subsequent operation of said means operative following conveyor advance to withdraw a carton blank and set same upon the conveyor and to close the end flaps of a filled carton said control means thereafter rendering itself quiescent pending receipt of a subsequent external signal.

15. An automatic cartonning apparatus comprising a conveyor, means for advancing said conveyor a predetermined distance, means operable following conveyor advance to withdraw a single carton blank from a stack of carton blanks and open same up to a set up condition ready to receive a plurality of articles on said conveyor at a first position, said carton in said set up condition having a closed bottom and open top end and side flaps, means for guiding articles into a set up carton at a second loading position displaced along the conveyor path a whole multiple of said predetermined distance from said first position, means operable following conveyor advance for closing the carton end flaps at a third carton flap closing position displaced along the conveyor path a whole multiple of said predetermined distance from said second loading position, means for closing the carton side flaps subsequently to the closing of the end flaps and control means for said conveyor advancing means, said means for advancing said conveyor, withdrawing a carton blank and closing the carton end flaps all being fluid operated means, and said control means comprising a motor adapted to be energized in response to an external signal, a cam shaft driven by said motor, a plurality of cams on said cam shaft, a control valve associated with each of said fluid operated means, each control valve being arranged to be operated by a respective one of said cams on said cam shaft, and means operated by another of said cam on said cam shaft for de-energizing said motor upon completion of a cycle of operation of said apparatus and preparatory to said motor receiving a subsequent external signal.

16. An automatic cartonning apparatus as claimed in claim 15 in which said motor is de-eneregized after one complete revolution of said cam shaft.

17. An automatic cartonning apparatus as claimed in claim 15 in which means are provided to lock said conveyor against movement, said means being responsive to said external signal to release said conveyor for advance and being responsive to the completion of conveyor advance to relock said conveyor.

* * * * *